United States Patent [19]

Bossons

[11] Patent Number: 4,555,432

[45] Date of Patent: Nov. 26, 1985

[54] WALL PLAQUES

[75] Inventor: William R. Bossons, Congleton, England

[73] Assignee: W. H. Bossons (Sales) Limited, England

[21] Appl. No.: 640,943

[22] Filed: Aug. 15, 1984

[30] Foreign Application Priority Data

Aug. 18, 1983 [GB] United Kingdom ..... 8322189

[51] Int. Cl.[4] ..... B44C 5/04

[52] U.S. Cl. ..... 428/156; 40/617; 248/496; 428/913.3

[58] Field of Search ..... 428/913.3, 542.2, 542.8, 428/156; 248/489, 495, 496; 40/152.1, 154, 617, 620

[56] References Cited

U.S. PATENT DOCUMENTS

| | | | |
|---|---|---|---|
| 1,019,151 | 3/1912 | Holmes | 248/489 |
| 1,794,327 | 2/1931 | Simon | 248/495 |
| 2,224,008 | 12/1940 | Auslander | 248/489 |
| 2,577,270 | 12/1951 | Riley | 428/913.3 X |
| 3,912,211 | 10/1975 | Topf | 248/489 |

FOREIGN PATENT DOCUMENTS

| | | | |
|---|---|---|---|
| 228984 | 2/1925 | United Kingdom | 428/913.3 |
| 678559 | 9/1952 | United Kingdom | 428/913.3 |
| 1245458 | 9/1971 | United Kingdom | 428/913.3 |

*Primary Examiner*—Henry F. Epstein

*Attorney, Agent, or Firm*—Wood, Herron & Evans

[57] ABSTRACT

A wall plaque has a fixing recess in its rear face, the recess having an upper and lower portion. The upper and lower portions are separated by a surface which extends inwardly and away from and at an angle to the rear face, and has ribs projecting into the lower portion extending across the recess. The plaque is supported on a picture hook such that the slope/ribs of the surface tends to cause the rear face of the plaque to remain flush with the wall.

5 Claims, 2 Drawing Figures

WALL PLAQUES

This invention relates to improvements in wall plaques.

BACKGROUND OF THE INVENTION

A wall plaque having a recess in its back face to receive a nail to support the plaque has been proposed in our British Pat. No. 1245458. Such an arrangement is only suitable for a relatively small and lightweight wall plaque, as relatively heavy plaques are not best supported on a wall simply by means of a nail.

It is an object of this invention to overcome or mitigate this problem.

SUMMARY OF THE INVENTION

In accordance with the invention, a wall plaque has a fixing recess in its rear face into which recess in use fits the head of a nail and a supporting hook member fixed to a wall by said nail, the recess having a surface either upwardly sloping away from the rear face and/or provided with a plurality of ribs so that when the plaque is supported by the resting of the sloping/ribbed surface on the support surface of the hook member, the slope/-ribs of the surface tend to cause the rear face of the plaque to remain flush with the wall, wherein said recess has an upper portion in which the head of the nail and the crown of the hook member are positioned and a lower portion in which the support surface of the hook member is positioned, when the plaque is flush with the wall.

Such an arrangement can support a plaque with the rear wall of the plaque flush with the supporting wall, the supporting member thus being hidden from view.

The invention will now be described, by way of example, with reference to the accompanying drawings.

DESCRIPTION OF THE PREFERRED EMBODIMENTS

Figure 1:
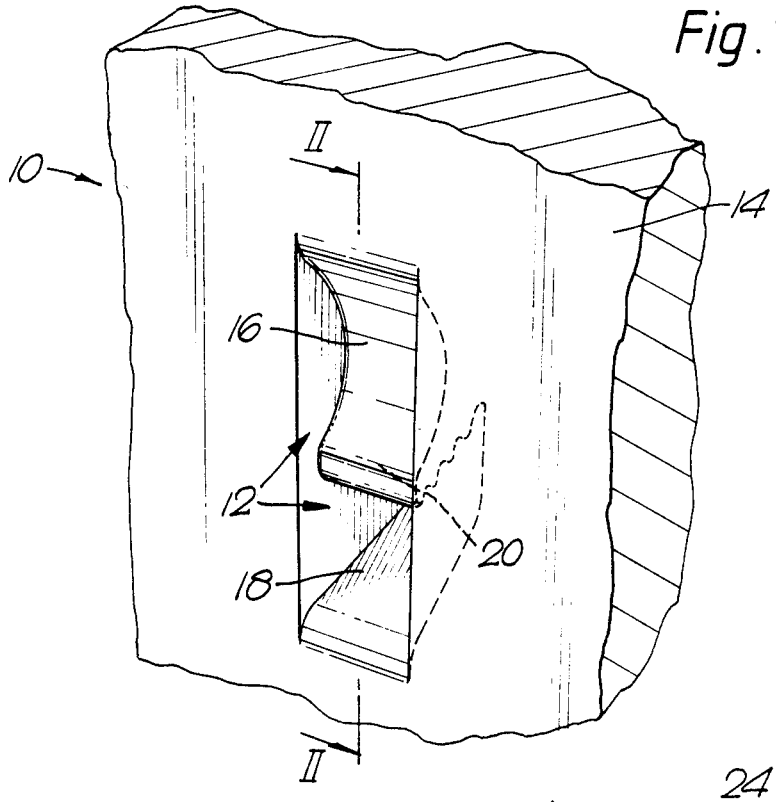
FIG. 1 is a perspective view of the rear face of a wall plaque according to the invention.

The wall plaque 10 has a fixing recess 12 in its rear face 14, the recess 12 having an upper portion 16 and lower portion 18.

The 'upper' and 'lower' portions are separated by a projecting tongue that defines a bottom surface 20 which extends inwardly away from and at an angle to the rear face 14, and has three ribs 22 projecting into the lower portion 18 extending across the whole of the recess. The angle $\beta$ at which the surface 20 extends from the horizontal (see 21 in FIG. 2) is preferably in the range of 2° to 10°.

Figure 2:
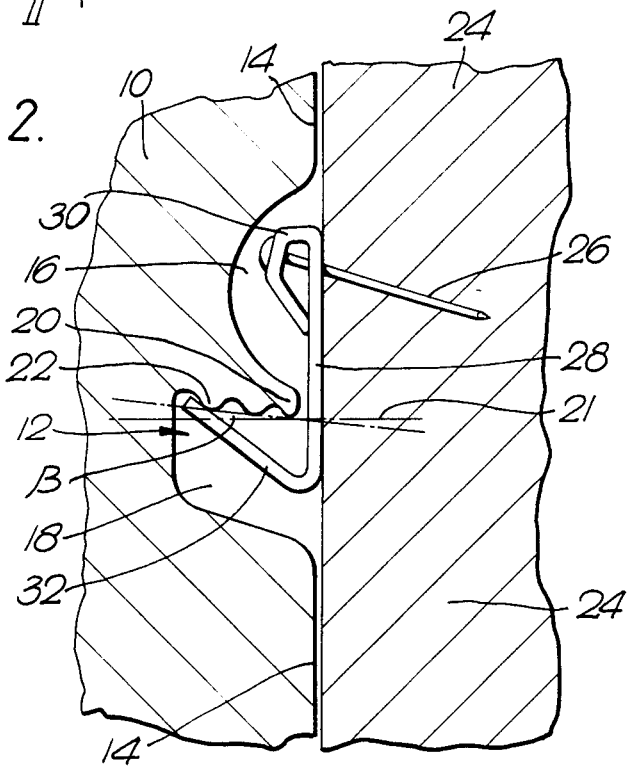
FIG. 2 is a cross sectional view of the plaque of FIG. 1 taken along the line II—II of FIG. 1.

The plaque 10 is supported on a supporting wall 24 by means of a nail 26 and a standard picture hook 28, which has an upper crown head 30 and lower upturned V-shaped supporting hook or strip 32, the head 30 and strip 32 being connected by a strap, all as shown in FIG. 2. The member 28 is fixed to the wall 24 by means of the nail 26 passing through the head 30 at an angle. In the supported position, the sloping surface 20 of the plaque is placed or hung on the free edge of supporting strip 32 of the member 28. The strip 32 extends within the lower portion 18 of the recess 12 while the crown head 30 and head of the nail 26 extend within the upper portion 16 of the recess 12. Note, as shown in FIG. 2, that the picture hook's strap that connects the hook's head portion 30 and hook portion 32 is also received in the plaque's recess 12 when the plaque is hung flush against the wall 24 because the free edge of the projecting tongue is positioned inwardly of the plaque's rear face 14.

The fact that the surface 20 in use slopes upwardly from the rear face tends to cause the rear wall 14 of the plaque to remain flush with the walls 24. The ribs 22 assist in retaining the plaque in this position as the front edge of the supporting surface 32 can lodge behind one of the ribs 22 and prevent dislodgement of the plaque from the wall.

An advantage of the invention is that a heavy wall plaque with appropriate recess 12 may be placed on a wall 24 safely and securely due to the use of a picture hook 28 which can cope with relatively large loads. Furthermore the arrangement is such that even a heavy wall plaque may be placed on a wall 24 while being flush thereto.

Although the invention has been described in terms of certain preferred embodiments, person skilled in the art to which this invention pertains will readily appreciate modifications and changes which may be made without departing from the spirit of the invention. Therefore, I do not intend to be limited except by the scope of the appended claims.

Having thus described the invention, what is claimed is:

1. A wall plaque adapted to be hung on a wall by a picture hook, said picture hook being of the type having an upturned V-shaped hook portion connected by a strap to a crown shaped head portion, said picture hook being mountable on a wall by a nail driven through said head portion, said wall plaque comprising an intermediary body portion having a front face and a rear face, structure defining a recess in said rear face, said recess having an upper portion sized to receive said hook's head portion, and having a lower portion sized to receive said hook's hook portion, said hook's head and hook portions being received in said recess's upper and lower portions, respectively, when said plaque is hung on a wall by said picture hook in a position where said plaque's rear face is flush against said wall, and a tongue within said recess that divides said recess into said upper and lower portions, a bottom surface of said tongue having at least one of (a) an upward slope away from said rear face, and (b) a plurality of ribs, said tongue resting on, and said plaque thereby being supported by, the free edge of said picture hook's portion when said plaque is hung on a wall by said picture hook, and at least one of said tongue's slope and said tongue's ribs cooperating with said hook portion's free edge to tend to cause said plaque's rear face to remain flush with the wall.

2. A wall plaque as set forth in claim 1, said tongue comprising a leading edge portion located inwardly of said plaque's rear face, that location of said tongue's leading edge permitting said picture hook's strap to be received within said recess so that portion of said plaque's rear face which surrounds said recess can be flush against the wall when said plaque is hung on a wall by said picture hook.

3. A wall plaque as set forth in claim 2, said tongue being formed integral with said plaque.

4. A wall plaque as set forth in claim 2, said tongue having both a sloped bottom surface and a plurality of ribs on said bottom surface.

5. A wall plaque as set forth in claim 1, said tongue's bottom surface being sloped to the horizontal in the range of about 2° to 10° when said plaque's rear face is vertical.

* * * * *